United States Patent [19]

Taussig et al.

[11] 3,986,716

[45] Oct. 19, 1976

[54] COMPOSITE RACQUET STRUCTURE

[75] Inventors: Frederick Taussig; Gregory O'C Corkery, both of St. Louis, Mo.

[73] Assignee: Arundale Manufacturers, Inc., St. Louis, Mo.

[22] Filed: Sept. 23, 1974

[21] Appl. No.: 508,077

[52] U.S. Cl. ..... 273/73 C; 273/73 D

[51] Int. Cl.[2] ..... A63B 49/10; A63B 49/12

[58] Field of Search ..... 273/67 R, 73 R, 73 C, 273/76, DIG. 1–12, 96 D, 73 D, 73 F, 73 G, 73 H, 73 J, 73 K; 29/472.9; 280/11.13 L, 11.13 M

[56] References Cited

UNITED STATES PATENTS

| | | | |
|---|---|---|---|
| 1,381,050 | 6/1921 | Agutter | 273/73 K |
| 1,508,286 | 9/1924 | Moore | 273/73 K |
| 1,539,019 | 5/1925 | Nikonow | 273/73 R |
| 1,636,867 | 7/1927 | Robinson | 273/73 K |
| 1,937,787 | 12/1933 | Robinson | 273/73 H |
| 2,164,631 | 7/1939 | Abell | 273/73 C |
| 2,274,788 | 3/1942 | Hatton | 273/73 K |
| 3,083,968 | 4/1963 | Takahashi | 273/73 R |
| 3,556,524 | 1/1971 | Carlton | 273/73 C |
| 3,647,211 | 3/1972 | Doessel et al. | 273/73 C |
| 3,664,669 | 5/1972 | Latham et al. | 273/73 D |
| 3,810,620 | 5/1974 | Decker et al. | 273/73 H |
| 3,814,423 | 6/1974 | Shockley et al. | 273/73 C |

FOREIGN PATENTS OR APPLICATIONS

| | | | |
|---|---|---|---|
| 1,442,020 | 5/1966 | France | 273/73D |
| 16,414 | 9/1891 | United Kingdom | 273/73 D |
| 424,742 | 2/1935 | United Kingdom | 273/96 D |
| 1,126,438 | 9/1968 | United Kingdom | 273/73 C |

*Primary Examiner*—Richard J. Apley
*Attorney, Agent, or Firm*—Rogers, Eilers & Howell

[57] ABSTRACT

A compound tennis racquet is formed of extruded metal tubing and injection molded plastic. The extruded tubing has a compound cross section with a recessed central portion. The metal tubing is formed into a circular loop to define the main head portion of the tennis racquet. The loop has two depending legs extending from the head to form a portion of the handle of the tennis racquet. A plastic material is injection molded around the major portion of the extruded metal tubing to encompass the handle portion and to encompass approximately to a third to one half the racquet head. The molded plastic is continuous in the recessed center portion of the tubing to form a continuous loop around the interior of the head area of the racquet. Holes are provided in the plastic portion for the tennis racquet strings. A hollow molded plastic grip extends beyond the extremities of the depending legs of the extruded metal handle portion.

18 Claims, 10 Drawing Figures

COMPOSITE RACQUET STRUCTURE

BACKGROUND AND SUMMARY OF THE INVENTION

Tennis racquets of metal and other lightweight materials are gaining great popularity over the conventional wooden racquet, which has been known for some time. The conventional wooden racquet has a high torsional resistance and a firmness which gives it a great deal of control of the path of the ball during volley. However, it has a number of disadvantages in that its stiffness causes a great deal of stress on the forearm and elbow area of the player and can result in a malady known as "tennis elbow."

Tennis elbow is believed to be due to irritation of the muscles and tendon tissues in the area of the elbow and forearm. The condition is aggravated by the effort required to move or stop the motion of the racquet and by the shock which is transmitted to the arm on impact of the tennis racquet with a ball. The extreme rigidity of the wooden racquet contributes to transmitting the shock on impact to the arm of the player. Other inherent design factors in the wooden racquet, such as location of the center of percussion near the base of the string area, also contribute to transmitting greater vibration to the player's arm by allowing resonant vibration to be set up along the length of the racquet.

The wooden tennis racquet, due to its solid throat and heavy head and handle areas, has a high wind resistance which slows the stroke of the player somewhat.

The newer metal racquets overcome a number of the deficiencies of the prior art wooden racquet, but do introduce additional problems. The metal racquets have less cross section and more open area, and thus have less wind resistance, which does increase the speed of the player's shot. In addition, the metal racquets are somewhat more flexible, which decreases to some extent the shock which is transmitted to the arm of the player.

The increased flexibility does cause some reduction in control of a shot, particularly on high impact shots, due to the greater angular deflection between the head and handle of the racquet on making a shot. This deflection is both in the direction perpendicular to the face of the racquet in a direction about the hand of the player and also is a twisting action which is apparent when the ball is struck off center. Metal racquets have a high vibrational mode so that a significant shock is transmitted to the player's arm on impact of the ball.

Metal racquets, as well as wooden racquets of prior art, have a high failure due to the stress concentrations that are inherent in the construction of the racquets. Metal racquets are prone to material fatigue in the throat and shoulder areas of the racquet, particularly in the areas where the structures are joined together, either by rivets or welds. Wooden racquets are prone to develop stress-related failure due to the stress concentration caused by string tension and holes in the structure through which the strings pass, as are metal racquets. In addition, wood racquets are prone to warpage due to changes in temperature and humidity.

Application has developed a new composite tennis racquet structure which mitigates the problem of prior art racquets. The structure is also adapted to squash, paddle-ball, badminton, or any other similar batting device. The structure has a light weight, yet can maintain a high moment of inertia, by placing the center of mass farther out toward the tip of the racquet than in previous racquets, and thereby maintaining good shot making properties in the lightweight racquet. The racquet has a good balance between rigidity and flexibility so that control of the shot is not impaired by the racquet, yet less shock is transmitted to the arm of the player on impact of the racquet with the ball. Placement of the center of percussion further toward the tip of the racquet and into the area of normal contact with the ball also contributes the reducing the amount of shock and resonant vibrations which are transmitted through the racquet handle to the arm of the player. The unique composite structure dampens the vibrations which are set up in the racquet on impact so that they are very quickly eliminated and less actual energy is transmitted to the forearm and elbow region of the player.

This damping effect is the result of encasing a metal structural member in a plastic support. The plastic material is continuous from the head to the handle and forms a unitary structure with the metal. The difference in the modulus of elasticity of the two materials and the different vibrational modes of the two materials effectively dampens the vibrations which are set up in the racquet on impact. By using the composite structure of the invention, high strength and very light racquet weight is achieved. Placement of the center of mass and center of percussion can be adjusted further toward the tip of the racquet, if desired, to relocate the center of percussion of the racquet. Relocation of the center of percussion is also facilitated by terminating the metal member at a location spaced from the end of the racquet handle and forming the grip portion as a hollow, molded plastic tube.

In addition, by using this unique composite construction it is possible to eliminate welds, rivets and other stress concentrating structure from the racquet frame, and thereby greatly eliminating failures in the head and throat area of the racquet due to material fatigue. The resulting racquet is both light in weight and strong.

Description of the Preferred Embodiment

Figures 1, 2, 3, 4, 5, 6, 7, 8, 9, 10:
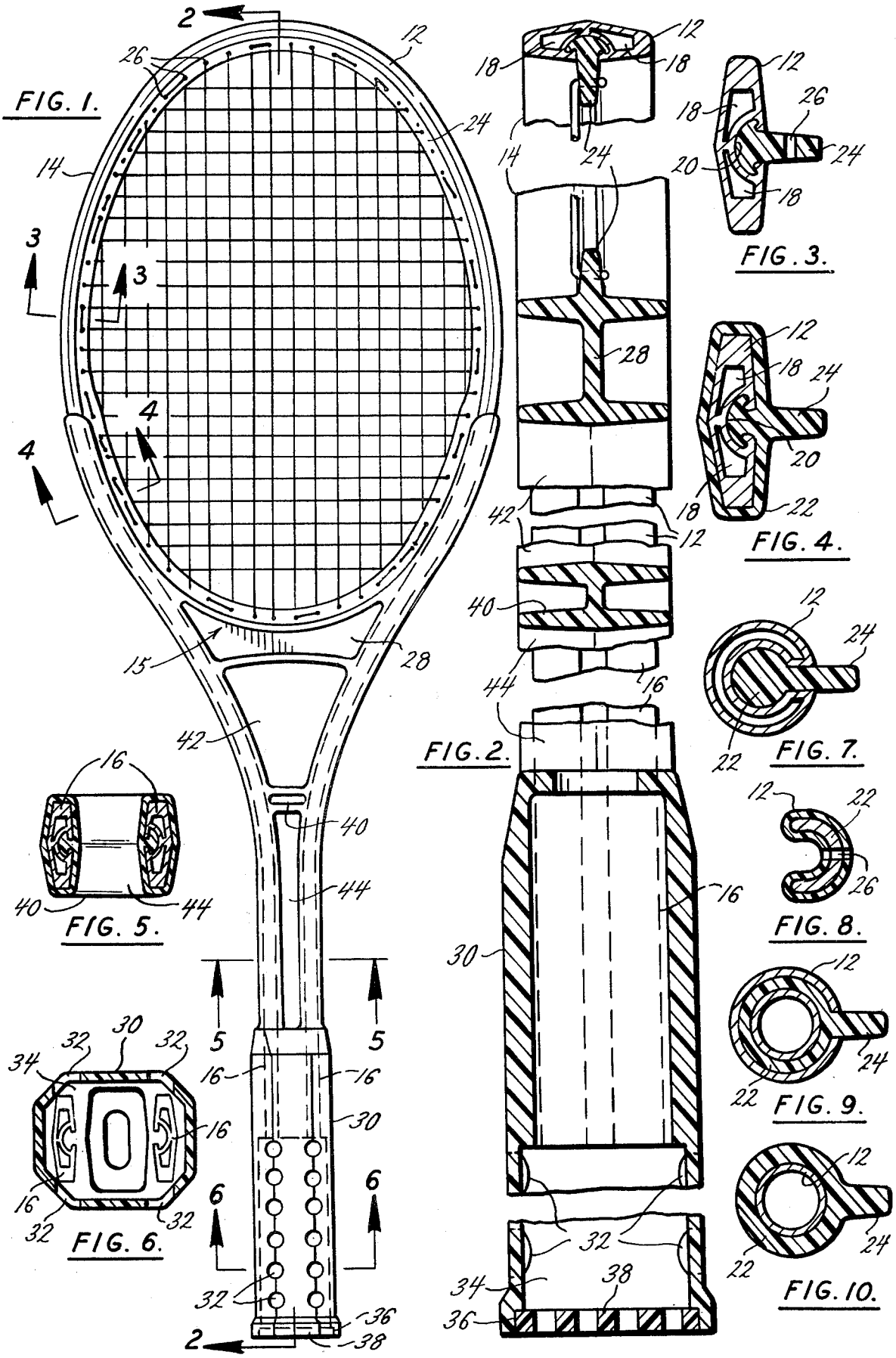
FIG. 1 is a plan view of a composite racquet embodying the concepts of the invention.
FIG. 2 is an enlarged side view of the racquet shown in FIG. 1 broken and in section along the plane of lines 2—2 of FIG. 1.
FIG. 3 is a cross section of a portion of the racquet head taken along the plane of line 3—3 in FIG. 1.
FIG. 4 is a cross section of the racquet head taken along the plane of line 4—4 in FIG. 1.
FIG. 5 is a cross section of the racquet handle taken along the plane of line 5—5 in FIG. 1.
FIG. 6 is a cross sectional view of the racquet grip taken along the plane of line 6—6 in FIG. 1.
FIGS. 7 through 10 are alternative designs of the composite structures for the plastic-filled tube, analagous to FIG. 3.

Referring in more detail to the drawing, FIG. 1 shows a compound tennis racquet according to the invention formed of a complex extruded aluminum tube 12. The complex tube 12 is formed into a generally elliptical head portion 14 roughly of 10½ by 8½ inch dimensions to make a standard size tennis racquet head. The curvature of the ellipse is interrupted at one end of the ellipse to form the throat 15 of the racquet and the tube 12 terminates in two depending legs 16 which project outwardly from the throat 15. As shown in FIG. 3, in cross section, tube 12 is of complex shape having hollow areas 18 and a recessed inner portion 20 which is open to the exterior of the tube.

Molded around a portion of the exterior surfaces of tube 12 is a plastic material 22, for example, nylon, which forms a continuous layer around depending legs 16 and up past the throat area 15 of the tennis racquet head 14, as shown. The plastic material fills opening 20 in tube 12 and is continuous therewith. In the head 14 of the tennis racquet, the plastic in opening 20 forms an inwardly extending flange 24 having cast-in holes 26 for the strings of the tennis racquet. At the throat 15 of the racquet, integral cross bracing 28 of the molded plastic 22 completes the envelope of the racquet head 14 and continues flange 24 around the complete inner circumference of the ellipse.

Legs 16 extend from head 14 and terminate at the handle end of the tennis racquet. Molded handle 30 extends beyond the terminus of legs 16 and is integral with the molded plastic material 22. Normally, legs 16 will extend only 1½ to 2 inches into handle 30. Handle 30 has perforations 32 and a hollow interior 34 vented at both ends of the handle to decrease the weight of the racquet, to allow air circulation through the handle, and to permit the balance and center of percussion to be adjusted. A conventional leather or plastic grip (not shown) may be applied over handle 30 so that perforations 32 permit the grip to breathe so that moisture does not build up on the grip and make it slippery. The opening 36 into the hollow interior 34 of handle 30 can be closed by a plastic mesh insert 38 for appearance, if desired.

Intermediate between handle 30 and cross support 28 is additional support 40 which strengthens the racquet and adds increased rigidity and torsional resistance to it.

Compound plastic and metal tube structures other than those shown in FIGS. 1 through 6 may be used. FIGS. 7–10 show compound structures which could be used to form the tennis racquet according to the concept of the invention.

By using a structure as disclosed, it is possible to make a very light tennis racquet having an unstrung weight in the neighborhood of 300 grams, for example, from 300 to 350 grams and having a center of percussion spaced from about one inch below the center of the racquet face to two inches above the center of the racquet face. The resulting racquet has a relatively high swing weight (moment of inertia) in comparison to the total mass of the racquet.

The structure of the racquet, formed by molding the plastic structure around and throughout the interstices of the tube in a composite structure, eliminates the necessity of using welds or rivets to join the structure together and eliminates stress concentration resulting from these structures. As a consequence, the racquet is extremely resistant to failures as a result of material fatigue which would normally occur in the area of such stress concentrating structures.

The difference in the vibrational mode of the two materials, for example, aluminum and molded nylon, allows the plastic and metal to vibrate at different frequencies, thus damping out the vibrations set up in the racquet as the result of impact between a racquet and a ball, particularly the vibrations set up along the racquet handle. The complex tube shape and the reinforcing structure of the molded plastic material also create a racquet which has high torsional resistance, both in the axis about the hand of the player and in the axis rotating about the handle of the racquet so that good control and play of the shot can be achieved. By molding the plastic material with open spaces, shown in FIG. 1 as areas 42 and 44, low wind resistance can be achieved.

The racquet can be formed by bending the complex extruded aluminum tubing, for example, heat treated type 6061 or type 7005 aluminum, into the basic shape of the tennis racquet head and handle and then injection molding the rest of the plastic structure into and around the racquet in a conventional injection molding operation. The holes 26 in the flange 24 and the perforations 32 in the handle can be molded integrally with the racquet or can be drilled subsequent to molding. The racquet can, of course, be strung by conventional means.

The plastic material may be of any conventional material, such as polyurethane, polypropylene, polystyrene, etc. The preferred material is nylon. The plastic may be used with or without fillers. When filled, it may contain up to about 40% filler by weight; commonly 10–30% filler would be used. Typical fillers which may be used are graphite, carbon black, silica, mica, molybdenum disulfide, glass fibers, boron fibers, glass, metal, or organic beads, or synthetic organic fillers such as DuPont PRD (TM).

It will be appreciated by one skilled in the art that a number of modifications may be made of the invention as disclosed without departing from the concepts of the invention, and it is intended that the invention is not to be limited by the foregoing description which is given for the purposes of illustration, but is intended to be limited only by the scope of the appended claims.

We claim:

1. A racquet having a compound metal and plastic structure, the racquet having a head portion and a handle portion, the metal being a tube and having the plastic integral with the tube as a supporting structure, the plastic being integral with the tube at least partially in the head area of the racquet and having a flange projecting into the head area of the racquet away from the inner peripheral surface of the metal tube and adapted to receive and independently support the strings of the racquet, and the plastic enclosing at least partially the handle area of the racquet.

2. The racquet of claim 1 wherein the tube is a complex metal tube.

3. The racquet of claim 2 wherein the plastic is around at least part of the metal tube.

4. The racquet of claim 3 wherein the tube is a complex metal tube having an interior space opening to the exterior of the tube.

5. The racquet of claim 4 wherein the plastic is around at least a part of the metal tube and occupies at least part of the interior space of the metal tube.

6. The racquet of claim 4 wherein the interior space opens to the exterior of the metal tube and a plastic flange is anchored in the interior space.

7. The racquet of claim 4 wherein the interior space of the metal tube opens into the head area of the racquet and a flange of plastic is anchored in the interior space, the flange extending from the metal tube into the head area of the racquet.

8. The racquet of claim 1 wherein the plastic is filled with from about 10 to 40% by weight of a filler.

9. The racquet of claim 7 wherein the plastic is continuous with a layer of plastic molded at least partly around the exterior of the metal tube and at least partly forming the handle of the racquet.

10. The racquet of claim 7 wherein the flange has means to receive the strings of the racquet.

11. The racquet of claim 1 wherein the tube is aluminum.

12. The racquet of claim 1 wherein the plastic is an injection moldable nylon.

13. The racquet of claim 1 wherein the plastic is filled with from about 10 to 40% by weight of a filler.

14. The racquet of claim 1 wherein the racquet has a face portion in the head portion and the center of percussion of the racquet is spaced from between about 1 inch below the center of the face to 2 inches above the center of the face.

15. The device of claim 1 wherein the racquet weighs less than about 380 grams.

16. A racquet having light weight, good balance, feel, and striking characteristics and having means to dampen vibrations initiated on contact of the racquet and a ball, the racquet having a head portion and a handle portion, the racquet being a complex metal tube having an interior space with an opening to the exterior of the tube, the tube comprising at least partially the head portion of the racquet with the opening in the interior of the head portion, the tube terminating in at least one projection extending outwardly from the head portion, the projection comprising at least partially the handle portion, a plastic supporting material integral with the tube at least partially surrounding the tube, and an integral flange of plastic material anchored in the interior space of the tube and extending into the interior of the head portion away from the inner peripheral surface of the metal tube, the flange having means for independently supporting the strings.

17. The racquet of claim 16 wherein the tube has at least one additional interior space.

18. The racquet of claim 16 wherein the plastic material extends around the outwardly extending handle portion of the tube and terminates in a grip portion, the handle being hollow in the grip portion and having perforations allowing air circulation in the area of the grip.

* * * * *